US007661481B2

(12) United States Patent
Todd et al.

(10) Patent No.: US 7,661,481 B2
(45) Date of Patent: Feb. 16, 2010

(54) DOWNHOLE WELLBORE TOOLS HAVING DETERIORABLE AND WATER-SWELLABLE COMPONENTS THEREOF AND METHODS OF USE

(75) Inventors: Bradley L. Todd, Duncan, OK (US); Trinidad Munoz, Jr., Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 255 days.

(21) Appl. No.: 11/447,475

(22) Filed: Jun. 6, 2006

(65) Prior Publication Data

US 2007/0277979 A1 Dec. 6, 2007

(51) Int. Cl.
*E21B 33/13* (2006.01)
*E21B 33/12* (2006.01)

(52) U.S. Cl. ..... 166/387; 166/120; 166/135; 166/192; 166/195; 166/212; 166/300; 166/376

(58) Field of Classification Search ..... None
See application file for complete search history.

(56) References Cited

U.S. PATENT DOCUMENTS

| | | | |
|---|---|---|---|
| 2,945,541 | A | 7/1960 | Maly et al. |
| 3,035,639 | A | 5/1962 | Brown et al. |
| 3,155,164 | A | 11/1964 | Kenner |
| 3,799,260 | A | 3/1974 | Barrington |
| 3,918,522 | A | 11/1975 | Suman, Jr. |
| 4,137,970 | A | 2/1979 | Laflin et al. |

(Continued)

FOREIGN PATENT DOCUMENTS

WO WO 2004/007899 A1 1/2004

(Continued)

OTHER PUBLICATIONS

"Advances in Polymer Science; Degradable Aliphatic Polyesters"; Springer; pp. 77-78, 2002.

(Continued)

*Primary Examiner*—Zakiya W. Bates
(74) *Attorney, Agent, or Firm*—John W. Wustenberg; Booth, Albanesi, Schroeder LLC

(57) ABSTRACT

An apparatus is provided for use as a downhole tool or a component thereof for insertion into a wellbore. According to one aspect, the apparatus has a body having a chamber, wherein at least a portion of the body is radially expandable; and a water-swellable material in the chamber, wherein the water-swellable material is dissolvable in water. According to another aspect, the apparatus has a body having a chamber, wherein at least a portion of the body is radially expandable, and wherein at least a portion of the body is made with a material that is deteriorable by hydrolysis; and a water-swellable material in the chamber. According to a further aspect, the water-swellable material is dissolvable in water. A process of temporarily blocking or sealing a wellbore is also provided, including moving an apparatus according to the invention through a wellbore to a selected position in the wellbore; exposing the water-swellable material to water or an aqueous fluid to expand the apparatus into engagement with the wellbore; performing a well completion, servicing, or workover operation in which the apparatus is contacted with fluids; and thereafter, allowing the deteriorable material to deteriorate and/or allowing the water-swellable material to dissolve.

38 Claims, 8 Drawing Sheets

U.S. PATENT DOCUMENTS

| | | | | |
|---|---|---|---|---|
| 4,155,404 | A | 5/1979 | Hollingsworth | |
| 4,378,843 | A | 4/1983 | Suman, Jr. | |
| 4,458,752 | A | 7/1984 | Brandell | |
| 4,706,746 | A | 11/1987 | White et al. | |
| 4,714,117 | A | 12/1987 | Dech | |
| 4,915,171 | A | 4/1990 | McMahan | |
| 4,936,386 | A * | 6/1990 | Colangelo | 166/292 |
| 4,968,184 | A | 11/1990 | Reid | |
| 5,097,902 | A | 3/1992 | Clark | |
| 5,143,015 | A | 9/1992 | Lubitz et al. | |
| 5,195,583 | A | 3/1993 | Toon et al. | |
| 5,220,959 | A | 6/1993 | Vance, Sr. | |
| 5,224,540 | A | 7/1993 | Streich et al. | |
| 5,271,461 | A | 12/1993 | Decker et al. | |
| 5,271,468 | A | 12/1993 | Streich et al. | |
| 6,527,049 | B2 | 3/2003 | Metcalfe et al. | |
| 6,629,567 | B2 | 10/2003 | Lauritzen et al. | |
| 6,659,178 | B2 | 12/2003 | Wilson et al. | |
| 6,688,395 | B2 | 2/2004 | Maguire et al. | |
| 6,688,399 | B2 | 2/2004 | Maguire et al. | |
| 6,691,789 | B2 | 2/2004 | Jackson et al. | |
| 6,834,725 | B2 | 12/2004 | Whanger et al. | |
| 6,880,642 | B1 * | 4/2005 | Garrett et al. | 166/382 |
| 6,896,058 | B2 | 5/2005 | Munoz, Jr. et al. | |
| 7,360,592 | B2 * | 4/2008 | McMahan | 166/207 |
| 2004/0231845 | A1 | 11/2004 | Cooke, Jr. | |
| 2004/0261996 | A1 | 12/2004 | Munox, Jr. et al. | |
| 2005/0205258 | A1 | 9/2005 | Reddy et al. | |
| 2005/0205265 | A1 | 9/2005 | Todd et al. | |
| 2005/0205266 | A1 | 9/2005 | Todd et al. | |
| 2006/0000617 | A1 * | 1/2006 | Harrall et al. | 166/380 |
| 2006/0213662 | A1 * | 9/2006 | Creel et al. | 166/286 |

FOREIGN PATENT DOCUMENTS

| | | |
|---|---|---|
| WO | WO 2006003112 A1 * | 1/2006 |

OTHER PUBLICATIONS

"Experimental study of the effect on high porewater salinity on the physical properties of a natural smectitic clay"; Roland Pusch; Mar. 2001; pp. 1-37.

* cited by examiner

DOWNHOLE WELLBORE TOOLS HAVING DETERIORABLE AND WATER-SWELLABLE COMPONENTS THEREOF AND METHODS OF USE

BACKGROUND

The present invention relates generally to downhole sealing tools and methods for use in subterranean wells.

In the drilling and completion of oil and gas wells, a great variety of downhole tools are used. For example, but not by way of limitation, it is often desirable to temporarily seal tubing, casing, flow parts, or other tubulars in the well. The downhole tools are commonly used to isolate (seal off) a portion of a wellbore during cementing, formation treatment, and other well treatment processes. Downhole wellbore sealing tools such as packers, bridge plugs, tubing plugs, straddle packers, fracturing plugs, and cement plugs are designed for these general purposes and are well known in the art of producing oil and gas.

When it is desired to remove one of these downhole tools from a wellbore, it is frequently simpler and less expensive to drill it out using a cutting tool such as a drill bit rather than to implement a complex and sometimes unreliable retrieving operation.

However, drilling a tool out is a relatively expensive and time consuming process, especially when used to remove downhole tools having relative hard components such as erosion-resistant hard steel. To help reduce the drilling time, downhole tools have been developed that are easier to drill out by selecting designs that allow certain components of the tool to be made of a composite material. Such devices have worked well and provide improved operating performances at relatively high temperatures and pressures. However, removal of these types of tools from the well still requires further intervention in the well by reentering the well for drilling them out, with the accompanying drilling cost and disruption of production.

Improvements in the area of downhole wellbore sealing tools are still needed and the present invention is directed to that need.

SUMMARY OF THE INVENTION

The present inventions relate to wellbore tools that can be installed in the wellbore and then substantially deteriorate or disappear from the well without further intervention in the well. The present inventions also relate to processes for temporarily sealing a downhole wellbore tubular with an apparatus according to the inventions.

DETAILED DESCRIPTION

Figure 1:
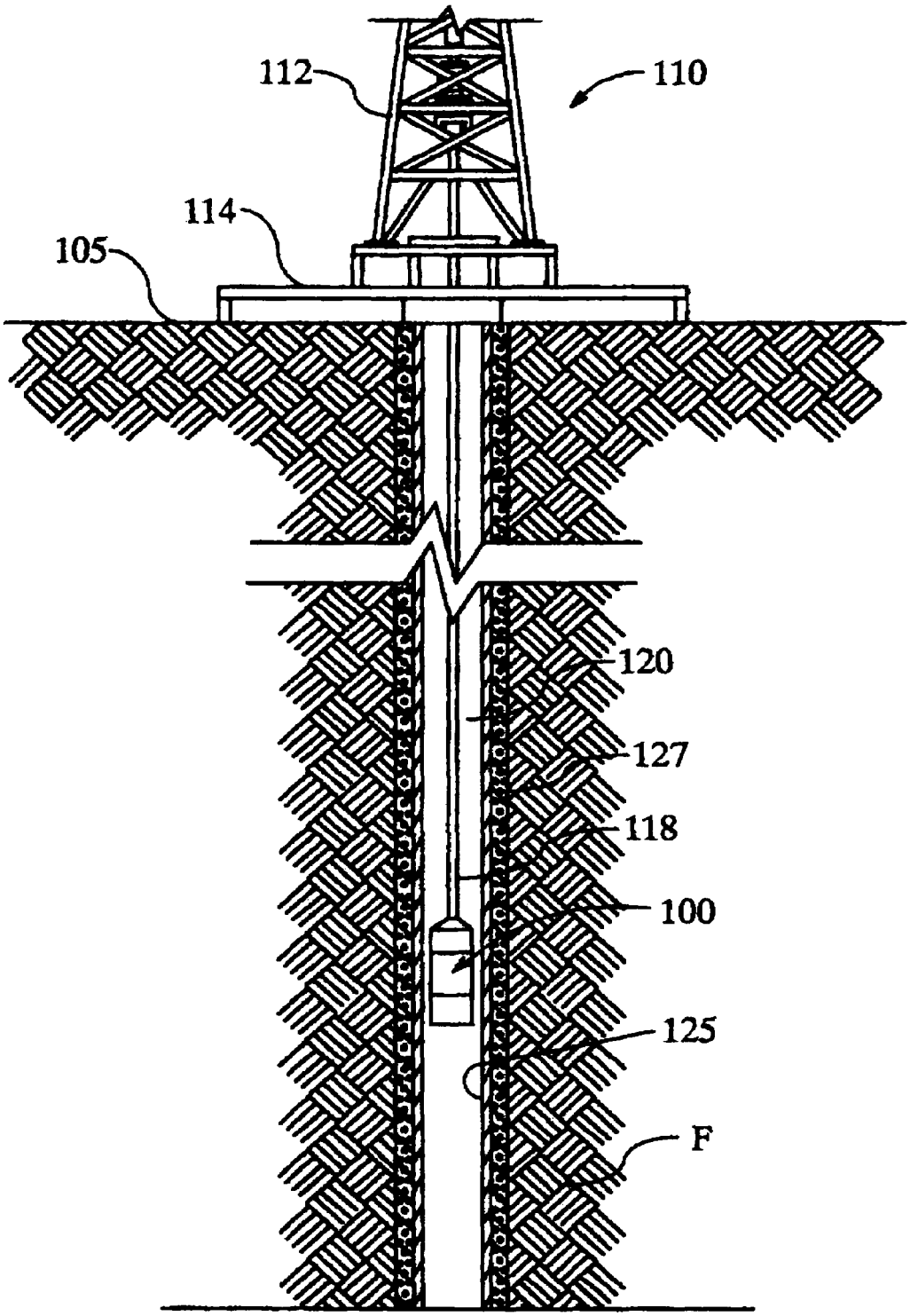
FIG. 1 is a cross-sectional view of an exemplary operating environment depicting a downhole tool according to the present invention being lowered into a wellbore extending into a subterranean formation.

FIG. 1 schematically depicts an exemplary operating environment for the downhole tool 100 of the present inventions. As depicted, a drilling rig 110 is positioned on the earth's surface 105 and extends over and around the wellbore 120 that penetrates a subterranean formation F for the purpose of recovering hydrocarbons. While the well is illustrated as being land based, it is envisioned that the present inventions could be used on wells located in a lake or sea bed in which case the rig could be suspended above the earth surface. The upper portion of the wellbore 120 can be lined with casing 125 that is cemented 127 into position against the formation F in a conventional manner. Although shown as a cased wellbore, the well can be either a cased completion as shown or an openhole completion.

The drilling rig 110 includes a derrick 112 with a rig floor 114 through which a tubing string 118, such as jointed pipe or coiled tubing, for example, extends downwardly from the drilling rig 110 into the wellbore 120. The drilling rig 110 is conventional and therefore includes a motor driven winch and other associated equipment for extending the tubing string 118 into the wellbore 120 to position the tool 100 at the desired depth. The tubing string 118 suspends the downhole tool 100 of the present inventions, which may comprise a packer, bridge plug, tubing plug, straddle packer, fracturing plug, cement plug, or other type of wellbore zonal isolation device, for example, as it is being lowered to a predetermined depth within the wellbore 120 to perform a specific operation. While the exemplary operating environment of FIG. 1 depicts a stationary drilling rig 110 for lowering and setting the downhole tool 100 within the wellbore 120, one of ordinary skill in the art will readily appreciate that instead of a drilling rig 110, mobile workover rigs, well servicing units, coil tubing rigs, wireline rigs, and the like, may be used to lower the tool 100 into the wellbore 120.

Structurally, the downhole tool of the present invention 100 can take a variety of different forms. In an embodiment, the tool 100 comprises a body having a chamber, wherein at least a portion of the body is radially expandable. The body is adapted to be of a size to pass through the wellbore and has at least a portion that is expandable to cause the body itself, a sealing element of the tool, or a gripping element of the tool to engage the wellbore 120.

According to one aspect of the invention, the body is made at least in part with a material that is deteriorable by chemical hydrolysis. The rate of hydrolysis can be facilitated by pH, enzymes, surfactants, or other chemical means. Examples of deteriorable materials are hereinafter described in detail.

In one embodiment, the tool or at least a component thereof deteriorates in the presence of aqueous well fluids present or introduced in the wellbore. According to this embodiment, the tool can comprise, for example, an enclosure for storing an aqueous solution or a chemical that releases water, which provides a source of water for use in degrading the material of a tool component by hydrolysis. Further according to these embodiments, the deteriorable material preferably deteriorates in the presence of well fluids present or introduced in the wellbore that are substantially harmless and substantially non-corrosive (over a similar exposure period) to other types of common structural materials of the wellbore or used in the wellbore, such as the metallic materials of the casing, the non-deteriorable plastic materials of the coil tubing, and the composite materials used in certain drillable plugs, etc.

One or more components of the body of plug 100, or portions thereof, can be formed with the deteriorable material. More specifically, the body or a component thereof comprises an effective amount of deteriorable material such that the plug 100 or the component desirably decomposes when exposed to a wellbore environment within a matter of hours or days, as further described below. Preferably, the deteriorable material will decompose in the presence of an aqueous fluid in a wellbore environment.

The deteriorable components may be formed of any material that is suitable for service in a downhole environment and that provides adequate strength to enable proper operation of the plug. The particular material matrix used to form the deteriorable components may be selected for operation in a particular pressure and temperature range, or to control the decomposition rate of the body of the plug 100 or a component thereof. Thus, a deteriorable plug 100 can be adapted to operate, for example, as a 30-minute plug, a three-hour plug, or a three-day plug, or a three-week plug.

Examples of deteriorable materials that may form the body or various other components of the deteriorable plug 100 include but are not limited to polymers that can be deteriorated by hydrolysis. The degradability of a polymer by hydrolysis depends at least in part on its backbone structure. The rates at which such polymers deteriorate are dependent on the type of repetitive unit, composition, sequence, length, molecular geometry, molecular weight, morphology (e.g., crystallinity, size of spherulites, and orientation), hydrophilicity, hydrophobicity, surface area, and additives. Also, the environment to which the polymer is subjected may affect how it deteriorates, e.g., temperature, the pH of aqueous well fluids, the use of any particular enzyme helpful to the hydrolysis reaction, and, if the material is also biodegradable, the presence of microorganisms.

Suitable examples of polymers that are deteriorable by hydrolysis and that may be used to form various components of the downhole tools 100 include for instance, the materials disclosed in co-pending U.S. patent application Ser. No. 10/803,668 filed on Mar. 18, 2004, and entitled "One-Time Use Composite Tool Formed of Fibers and a Degradable Resin" and co-pending U.S. patent application Ser. No. 10/803,689, filed on Mar. 18, 2004, and entitled "Biodegradable Downhole Tools," which are owned by the assignee hereof, and are hereby incorporated for all purposes herein by reference in their entirety. If there is any conflict in the usage or definitions of the terminology between that used herein and that incorporated by reference, the usage or definitions herein will control for all purposes herein.

Examples of such deteriorable polymers can include homopolymers, random, block, graft, and star- and hyperbranched aliphatic polyesters. Polycondensation reactions, ring-opening polymerizations, free radical polymerizations, anionic polymerizations, carbocationic polymerizations, coordinative ring-opening polymerization, and any other suitable process may be used to prepare such suitable polymers. For specific examples, the deteriorable material preferably comprises one or more compounds selected from the group consisting of: polysaccharides; chitin; chitosan; proteins; and aliphatic polyesters. Of these suitable polymers, aliphatic polyesters are preferred. Suitable examples of aliphatic polyesters include poly(lactides); poly(glycolides); poly(glycocide-co-lactide); poly(ϵ-caprolactones); poly(hydroxybutyrates); poly(anhydrides); aliphatic polycarbonates; poly(orthoesters); poly(amino acids); poly(ethylene oxides); and polyphosphazenes.

Preferably, the deteriorable material is elastically or plastically deformable. Accordingly, the deteriorable material can preferably further comprise a plasticizer. For example, where the deteriorable material is poly(lactic acid), the plasticizer preferably comprises a derivative of oligomeric lactic acid.

The plasticizers may be present in any amount that provides the desired characteristics. For example, the plasticizer discussed above provides for (a) more effective compatibilization of the melt blend components; (b) improved processing characteristics during the blending and processing steps; and (c) control and regulate the sensitivity and degradation of the polymer by moisture. To achieve pliability, the plasticizer is present in higher amounts while other characteristics are enhanced by lower amounts. The compositions allow many of the desirable characteristics of pure deteriorable polymers. In addition, the presence of plasticizer facilitates melt processing, and enhances the degradation rate of the compositions in contact with the wellbore environment. The intimately plasticized composition should be processed into a final product in a manner adapted to retain the plasticizer as an intimate dispersion in the polymer for certain properties. These can include: (1) quenching the composition at a rate adapted to retain the plasticizer as an intimate dispersion; (2) melt processing and quenching the composition at a rate adapted to retain the plasticizer as an intimate dispersion; and (3) processing the composition into a final product in a manner adapted to maintain the plasticizer as an intimate dispersion. In certain embodiments, the plasticizers are at least intimately dispersed within the aliphatic polyester.

In various embodiments, the plug 100 or a component thereof is self-deteriorable. That is, the plug 100, or a portion thereof, is formed from materials comprising a mixture of a polymer that is deteriorable by hydrolysis, such as aliphatic polyesters, and a hydrated organic or inorganic solid compound capable of releasing water. The deteriorable polymer will at least partially deteriorate in the releasable water provided by the hydrated organic or inorganic compound, which dehydrates over time when heated due to exposure to the higher temperatures present at greater depths in a wellbore environment.

Examples of the hydrated organic or inorganic solid compounds that can be utilized in the self-deteriorable plug 100 or self-deteriorable component thereof include, but are not limited to, hydrates of organic acids or their salts, such as sodium acetate trihydrate, L-tartaric acid disodium salt dihydrate, sodium citrate dihydrate, hydrates of inorganic acids or their salts, such as sodium tetraborate decahydrate, sodium hydrogen phosphate heptahydrate, sodium phosphate dodecahydrate, and other hydrated organic materials, such as amylose, starch-based hydrophilic polymers, and cellulose-based hydrophilic polymers. Of these, sodium acetate trihydrate is preferred.

As stated above, the deteriorable material forming components of the plug 100 may be selected to control the decomposition rate. However, in some cases, it may be desirable to catalyze decomposition of the plug 100 or a component by applying a chemical solution to the plug 100. The chemical solution can comprise an acidic fluid or a basic fluid, and may be applied before or after the plug 100 is installed within the wellbore 120. Further, the chemical solution may be applied before, during, or after the fluid recovery operations. For those embodiments where the chemical solution is applied before or during the fluid recovery operations, the deteriorable material, the chemical solution, or both may be selected to ensure that the plug 100 or a component thereof decomposes over time while remaining intact during its intended service life.

According to another aspect of the invention, a water-swellable material is located in the chamber. An aqueous fluid that causes swelling of the water-swellable material is introduced into the chamber while the tool 100 is held in the proper location in the well. Swelling of the water-swellable material causes an expandable portion of the body itself, a sealing element of the tool, or a gripping element of the tool to engage the interior wall of the wellbore, casing, or other tubular.

The amount of swelling needed to engage the tool with the interior wall of a casing or other tubular partly depends on the internal diameter ("I.D.") of the tubular. For example, in the context of the sizes of tubulars that would be typically used in a wellbore, for a larger-size tubular, to go from drift to the I.D. of the tubular to the nominal I.D. of the tubular would require about a 2.5% increase in radial diameter, and for a downhole tool to sealingly engage the I.D. of the tubular would require about 5% radial diameter increase of the portion of the downhole tool that is adapted to engage the interior wall of the tubular. This takes into account the drift diameter and ⅛" radial off-set. For smaller tubing sizes, to engage the wellbore would require about 10% to about 20% radial diameter increase of the portion of the downhole tool that is adapted to engage the interior wall of the tubular.

A "water swellable material" is one which swells in the presence of water or aqueous fluid. A fluid is considered to be "aqueous" herein if the fluid comprises water alone or if the fluid contains water. As used herein, a material is considered to be "water swellable" if a volume of the material can expand in the presence of an aqueous fluid at least 2.5%. Some of these types of materials are known to expand in an aqueous fluid about 100%. Preferably, the water swellable material is capable of expanding in the range of about 2.5% to about 100%, and most preferably the water swellable material is capable of expanding in the range of about 5% to about 25%.

It is noted, however, that the water-swellable material may be sensitive to pH and other factors, and that a material is considered to be "water-swellable" if the material can expand at least about 2.5% when exposed to at least one type of aqueous fluid, even if it does not expand at all in the presence of other types of aqueous fluids. For example, a material can be considered to be "water-swellable" if a volume of the material expands in the presence of an aqueous fluid having a basic pH, even if it does not expand in an acidic fluid. By way of a more specific example, anhydrous sodium tetraborate can be water-swellable when exposed to basic aqueous fluids, but it may swell only a few percent or not at all in some neutral or acidic solutions.

According to a further aspect of the invention, a preferred characteristic of the water-swellable material is that it be soluble or dissolvable in water. After initially swelling, this allows the water-swellable material to dissolve over time in an aqueous well fluid. This can be useful for removing or washing away the water-swellable material from the wellbore.

The solubility of a substance is the maximum amount of a material (called the solute) that can be dissolved in given quantity of a given solvent at a given temperature. As used herein, the definition for solubility is that: (1) a "soluble" material can form at least a 0.10 molar solution at 25° C.; and (2) an "insoluble" material cannot form a 0.10 molar solution at 25° C. As used herein, a material is considered soluble even if it takes a substantial amount of time to reach saturation. In other words, as used herein "soluble" includes materials that are eventually soluble after the use of a downhole tool so that it first deteriorates without requiring a mechanical removal of the tool. As used herein, a material is considered to be "dissolvable" if itself and/or its hydrated product or products is or are "soluble." For example, in addition to being a water-swellable material under certain conditions, anhydrous boric oxide swells in water and forms hydrate products with water, and the hydrate products are water soluble.

Suitable examples of swellable material that can be used in the downhole tools 100 include for instance, the anhydrous sodium borate materials disclosed in U.S. Pat. No. 6,896,058, issued on May 24, 2005 and entitled "Methods of Introducing Treating Fluids into Subterranean Producing Zones," which is owned by the assignee hereof, and is hereby incorporated for all purposes herein by reference in their entirety. If there is any conflict in the usage or definitions of the terminology between that used herein and that incorporated by reference, the usage or definitions herein will control for all purposes herein.

The water-swellable material is preferably in the form of a particulate solid. The water-swellable material is preferably substantially dehydrated or anhydrous borate material which swells when hydrated and dissolves over time. The particulate solid anhydrous borate material utilized hydrates when in contact with the aqueous fluid and converts to the hydrated form of borate material. The hydrated borate material then eventually dissolves in the aqueous fluid thereby eliminating the need for contacting the subterranean zone with one or more clean-up fluids. This may happen, for example, once the outer jacket has deteriorated and the swellable material is exposed to a greater volume of aqueous fluids.

The particulate solid anhydrous borate materials which can be utilized in accordance with this invention include, but are not limited to, anhydrous sodium tetraborate (also known as anhydrous borax), anhydrous boric acid, and anhydrous boric oxide. Another advantage of the particulate solid anhydrous borate materials of this invention is that the melting points of the materials are high, i.e., 741° C. (1367° F.) for anhydrous sodium tetraborate and 450° C. (840° F.) for anhydrous boric oxide, and as a result, the materials do not soften at high subterranean zone temperatures.

As disclosed in U.S. Pat. No. 6,896,058, the examples therein demonstrate the degradation over time of anhydrous sodium tetraborate and anhydrous boric acid in seawater solutions of scale inhibitors and 15% hydrochloric solutions. The amount of borate material and the volume of solutions used in the degradation experiments were chosen to simulate downhole conditions (i.e., perforation and well bore volumes). The degradation experiments were carried out in a sealed cell equipped with a sight glass, pressurized with nitrogen to 200 psi and a temperature of 250° F. The degradation (e.g., hydration) of the borate materials was measured by recording the change in volume of the borate materials over time.

For example, anhydrous boric oxide in various seawater solutions of scale inhibitors or 15% hydrochloric acid swelled at least to about 120% of its original volume, and more typically in the range of about 150% to about 210% of its original volume, depending on the particular aqueous solution. Anhydrous sodium tetraborate in a 10% ammonium salt containing a scale inhibitor/seawater solution swelled to about 120% of its original volume, although in other solutions it swelled only a few percent or not at all.

These anhydrous borate materials are only slightly soluble in water. However, with time and heat in the subterranean zone, the anhydrous borate materials react with the surrounding aqueous fluid and are hydrated. The resulting hydrated borate materials are highly soluble in water as compared to the anhydrous borate materials and as a result are eventually dissolved in the aqueous fluid. The total time required for the anhydrous borate materials to deteriorate and dissolve in an aqueous fluid is in the range of from about 8 hours to about 72 hours depending upon the temperature of the subterranean zone in which they are placed.

According to one embodiment, the water-swellable material preferably comprises a substantially dehydrated or anhydrous boric oxide. Other names for anhydrous boric oxide include diboron trioxide, boric anhydride, anhydrous boric acid. Boric oxide, CAS No. 1303-86-2, has a chemical formula of $B_2O_3$ and is reported in the chemical literature to have a formula weight of 69.61 g/mol, and a density of about 1.844 g/cm$^3$ at 18-25° C. Boric oxide is typically found in the vitreous state as a colorless glassy solid. The normal glassy form of boric oxide has no definite melting point. It begins to soften at about 325° C. (617° F.). Two crystalline forms can be obtained under high pressure. One of these can also be made at atmospheric pressure. The melting point of the latter has been reported as 450±2° C. if made at atmospheric pressure and 465°±10° C. if made at high pressure. Boric oxide is typically obtained as a white powder. Boric oxide has no melting point, but a progressive softening and melting range from 300-700° C. The crystals begin to break down at 300° C., and a series of suboxides are produced with partial melting until full fusion is reached at 700° C. Boric oxide is chemically hygroscopic, meaning that it absorbs moisture or water from the air. Moisture causes caking of product. Boric oxide rapidly hydrates to boric acid.

Boric acid is another water swellable material. Other names for anhydrous boric acid include orthoboric acid and boracic acid. Boric acid, CAS Number 10043-35-5, has a chemical formula of $H_3BO_3$ and a formula weight of 61.83 g/mol. Boric acid is crystalline, stable under normal conditions, free flowing, and easily handled. It is typically available as pieces, granules, and powder. The apparent density is about 2.46 g/cm$^3$, its melting temperature is 171° C. (when heated in closed space), softening point is in the range of about 300-400° C., its specific gravity is about 1.51, and its solubility in water is about 4.7% @ 20° C. or 27.5% @ 100° C. The pH of boric acid in water is 6.1 @ 20° C. for a 0.1% solution.

Boric acid actually refers to any one of the three chemical compounds, orthoboric (or boracic) acid, metaboric acid, and tetraboric (or pyroboric) acid; however, the term often refers simply to orthoboric acid. The acids may be thought of as hydrates of boric oxide, $B_2O_3$. Orthoboric acid, $H_3BO_3$ or $B_2O_3.3H_2O$, is colorless, weakly acidic, and forms triclinic crystals. It is fairly soluble in boiling water (about 27% by weight) but less so in cold water (about 6% by weight at room temperature).

When orthoboric acid is heated above 170° C. it dehydrates, forming metaboric acid, $HBO_2$ or $B_2O_3.H_2O$. Metaboric acid is a white, cubic crystalline solid and is only slightly soluble in water. It melts at about 236° C., and when heated above about 300° C. further dehydrates, forming tetraboric acid, $H_4B_4O_7$ or $B_2O_3.H_2O$. Tetraboric acid is either a vitreous solid or a white powder and is water soluble. When tetraboric or metaboric acid is dissolved it reverts largely to orthoboric acid.

Although preliminary test results indicate it is not water-swellable to the degree of anhydrous boric oxide, substantially dehydrated or anhydrous sodium borate can be used according to the invention. Anhydrous sodium borate is also known variously as dehydrated borax, boron sodium oxide; anhydrous borax; dehybor; sodium pyroborate; and sodium tetraborate. Anhydrous sodium borate, CAS No. 133043-4, has a chemical formula $Na_2B_4O_7$ and formula weight of 201.22. The generally known properties of the anhydrous tetraborate include being white, free-flowing crystals, hygroscopic, having a melting point of 741° C. (1,367° F.), having a specific gravity of 2.37, and being slightly soluble in cold water at about 4 g/100 ml at 20° C., very soluble in hot water, insoluble in acids, being a weak base with a pH of 9, and non-combustible.

A hydration product of the anhydrous sodium tertraborate is sodium borate decahydrate, CAS NO. 1303-96-4, having a chemical formula $Na_2B_4O_7.10H_2O$ and formula weight of 381.4. It is a product of the hydration of anhydrous sodium borate. The generally known properties of the decahyrate include being a white, gray, bluish or greenish white streaked crystals, odorless, solubility in water of about 5 g/100 ml at 20° C. and 65 g/100 ml at 100° C., having a specific gravity of 1.73, a melting point of 75° C. (167° F.), and a boiling point of 320° C. (608° F.) (losing water).

According to a yet another aspect of the invention, a preferred characteristic of the water-swellable material is that it also be suspendable in water. After initially swelling, this allows the water-swellable material to be suspended over time in an aqueous well fluid. This can be useful for removing or washing away the water-swellable material from the wellbore.

The suspendability of a substance is the maximum amount of a material that can be suspended in given quantity of solvent at a given temperature. As used herein, the definition for suspendability is that: (1) a "suspendable" material can form a 10% by weight suspension at 25° C.; and (2) a "non-suspendable" material cannot form a 10% by weight suspension at 25° C. As used herein, a material is considered to be "suspendable" if either itself or its deteriorated (i.e., hydrated) product or products is or are "suspendable" in an aqueous fluid without the use of a viscosifying agent in the fluid and without substantial mechanical agitation of the material with the fluid.

An example of a water-swellable material that is also water suspendable is calcium oxide, also known as lime, which is a strongly alkaline material that can swell and generate heat when moistened and under some conditions can even burst its container. When calcium oxide is mixed with water, it chemically reacts to form calcium hydroxide, also known as slaked lime. However, calcium hydroxide is substantially insoluble, i.e., its solubility is only about 0.18 g/100 ml water at 0° C. The two factors that enable lime to be so effective a base, despite its low solubility in water, are: (1) The smallness of the hydrated lime particle size and (2) the double hydroxyl groups that result from each molecule of lime that does go into solution (dissociates in water). The hydrated lime particle is so small that, when the lime/water mixture is agitated, the lime particles stay in suspension for a relatively long time, even if the agitation is stopped. This is due to "brownian motion" (the constant vibration of water molecules) which constantly buffet the suspended lime particles. If the solution is constantly agitated (mixed) the particles will remain in suspension indefinitely. The suspended particles have a very high total surface area, which means that, as the lime in solution is used up in reactions, more lime quickly dissolves into the solution. Thus, although the hydrated lime particle is substantially insoluble, an appreciable amount can be suspended in water. A suspension of fine calcium hydroxide particles in water is called lime water (or milk of lime). A milk of lime with a typical lime concentration of 150 g/l will have about 1.6 g/l of hydrated lime in solution and about 148.4 g/l in suspension.

In addition, the solubility of a chemical compound in water can be affected by pH and related factors. For example, calcium oxide swells and hydrates to calcium hydroxide, which is insoluble in water, but it is soluble in acid, due to the alkaline calcium hydroxide reacting with the acid in the solution. Thus, calcium oxide can swell in the presence of water having a neutral or basic pH, but in the presence of an aqueous solution having an acidic pH would be expected to cause the swelling to be overcome by the quick dissolving of the calcium hydroxide. More precisely, of course, the calcium hydroxide itself is not dissolvable in an acid, but rather it reacts with the acid to form soluble salts of calcium. This suggests that calcium hydroxide can be used as a water-swellable material with a non-acidic aqueous solution, and then subsequently washed out as a suspension or dissolved with an acid. Choosing a deteriorable material for the body that generates an acid, such polylactic acid, would enhance the solubility of a swellable material such as calcium oxide.

According to another aspect of the invention, a process of temporarily blocking or sealing a wellbore is provided. According to this aspect, the process comprises the steps of: (a) moving an apparatus through a wellbore to a selected position in the wellbore, the apparatus comprising a body having a chamber, wherein at least a portion of the body is radially expandable, and a water-swellable material in the chamber, wherein the water-swellable material is dissolvable or suspendable in water; (b) exposing the water-swellable material to water or an aqueous fluid to expand the apparatus into engagement with the wellbore; (c) performing a well completion, servicing, or workover operation in which the apparatus directs the flow of fluid; and (d) thereafter, allowing the water-swellable material to dissolve or be suspended in an aqueous fluid. Most preferably, the water-swellable material is water soluble.

According to yet another aspect of the invention, a process of temporarily blocking or sealing a wellbore is provided. According to this aspect, the process comprises the steps of: (a) moving an apparatus through a wellbore to a selected position in the wellbore, the apparatus comprising a body having a chamber, wherein at least a portion of the body is radially expandable and wherein at least a portion of the body is made with a material that is deteriorable by hydrolysis; and a water-swellable material in the chamber; (b) exposing the water-swellable material to water or an aqueous fluid to expand the apparatus into engagement with the wellbore; (c) performing a well completion, servicing, or workover operation in which the apparatus directs the flow of fluid; and (d) thereafter, allowing the deteriorable material to deteriorate.

According to these aspects, with the tool in place one or more other well completion, servicing, or workover operations can be performed on the well such as cementing, perforating, acidizing, fracturing, or the like, with or without the tool 100 remaining connected to the rig 110. For example, the well completion, servicing, or workover operation can advantageously further comprise the step of introducing a fluid into the wellbore at a sufficient rate and pressure to create at least one fracture in a zone of a subterranean formation penetrated by the wellbore. After completion of the one or more well processes, the tool is left in the well without any necessity for further intervention in the well to remove the tool 100 to reopen the well.

If present, the deteriorable material deteriorates over time releasing the tool from the wellbore. If the water-swellable material is also water soluble or water suspendable, over time the water-swellable material dissolves or suspends in an aqueous fluid. Most preferably, the water-swellable material is water soluble. Over time, the deteriorable material of the body deteriorates and opens the chamber to fluids in the well.

FIGS. 2-5 are enlarged schematic cross-sectional views of a wellbore casing 200 with an embodiment of the downhole tool 202 of the present inventions disposed therein. These figures show the tool 202 in a sequence of steps according to the methods of the present inventions.

Figure 2:
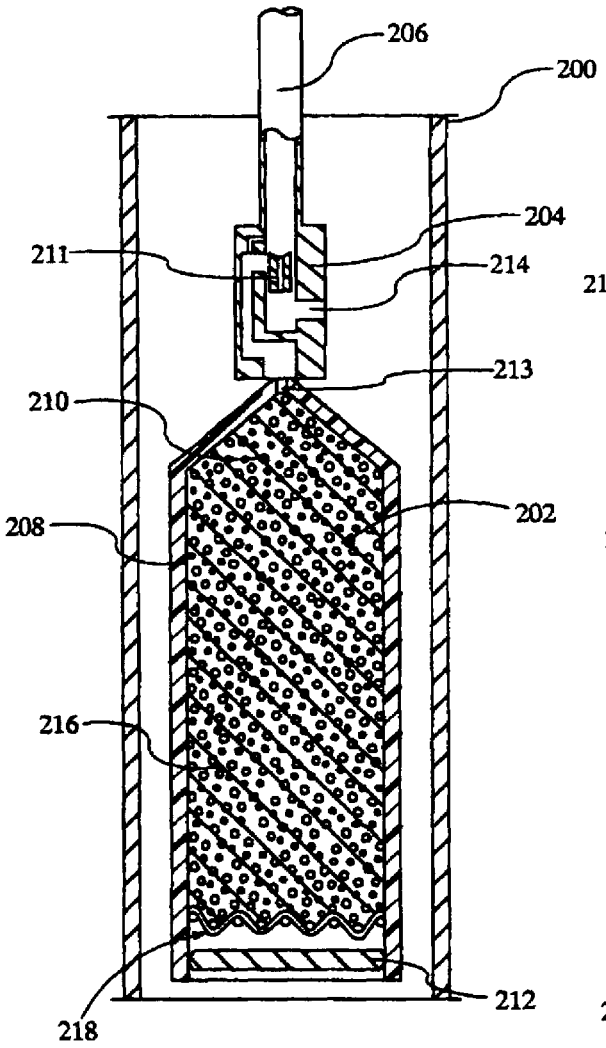
FIG. 2 is a cross-sectional view of a wellbore casing having disposed therein a downhole tool according to an embodiment of the present invention.

In FIG. 2 the tool 202 is shown suspended in the wellbore by a running tool 204 attached to a coil tubing string 206. The tool 202 is shown embodied in the form of a bridge plug that is a plug of the type that when installed closes off the wellbore and prevents the flow of fluids through the wellbore past the plug.

The tool 202 has a body formed from a radially expandable shell 208 made from a deteriorable material. In the illustrated embodiment the shell has a shape and size to allow the tool to be positioned in the wellbore from the surface. For example, the downhole tool should have outer radial dimensions, such as a overall outer diameter, that is less than the drift diameter of the tubular that the downhole tool is intended to engage or seal. The tool is sufficiently radially expandable so that once it is placed in a wellbore it can be expanded to engage and plug the wellbore. In the illustrated embodiment the body is tubular with a cylindrical cross section; however other cross section shapes, such as, square, triangular, clover leaf, elliptical, folded or the like could be used. The shell 208 is made from deteriorable material that is deformable.

The shell 208 defines a chamber that is closed on its lower end by a removable plug 212. In the illustrated embodiment the plug 212 can be removed by increasing the pressure inside the chamber 210 above that of the wellbore at the tool 202. A fill port 213 in the shell 208 at the upper end of the chamber is in fluid communication with the coil tubing 206 through a closed fill valve 211 in the running tool 204. As is show in FIG. 2, the running tool 204 has a recirculation port 214 that places the coil tubing in communication with the wellbore 200 during run-in.

According to the present invention, an effective volume of water-swellable material 216 in pellet form is located in chamber 210 in a non-aqueous fluid, such as oil. A screen 218 spans the lower end of the chamber. The grid of the screen is selected to be of a size to retain the material 216 in the chamber after the plug 212 is displaced.

Figure 3:
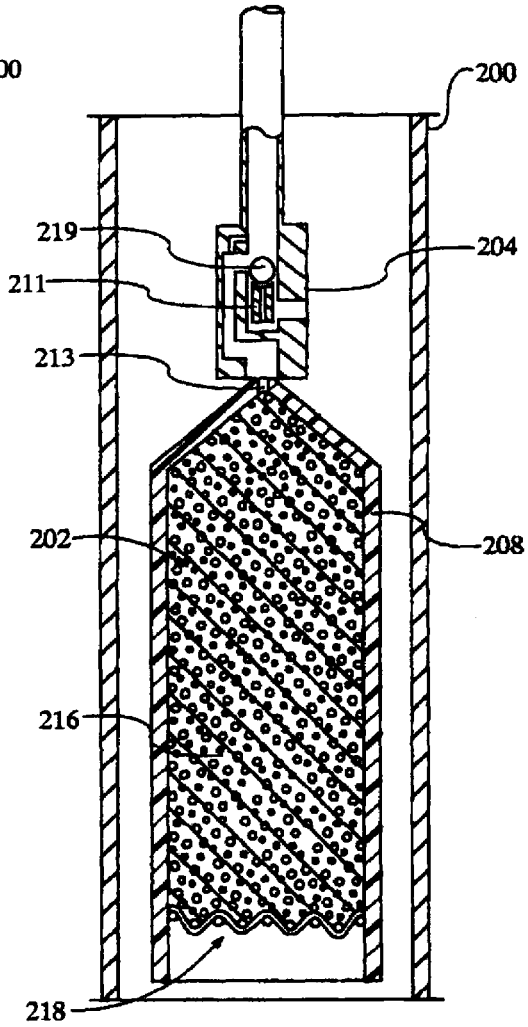
FIG. 3 is a cross-sectional view of the tool of FIG. 2 shown during hydrating of a water-swellable material.
Figure 4:
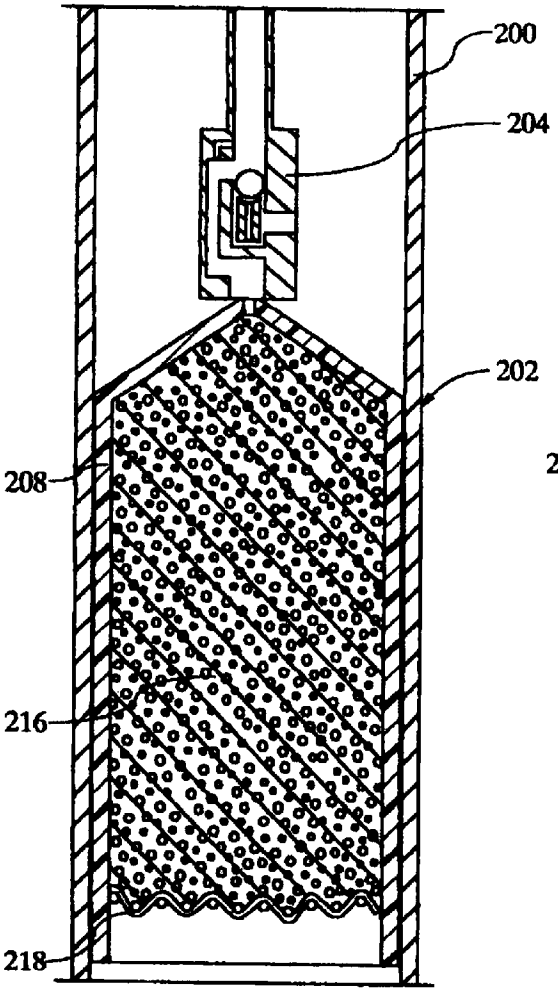
FIG. 4 is a cross-sectional view of the tool of FIG. 2 shown with the tool engaging in the wellbore.

In FIG. 3, the plug is shown after a ball 219 has pumped down the coil tubing 206 to block the recirculation port 214 and move the element of fill valve 211 placing the coil tubing in fluid communication with the chamber. Continued pumping an aqueous fluid down the coil tubing will dislodge the plug 212 and will displace the non-aqueous fluid therein. As shown in FIG. 4, exposure of the swellable material to an aqueous fluid hydrates the material 216, which in turn swells while remaining trapped in the chamber by the screen 218. As swelling continues the shell 208 is expanded to block the wellbore and anchor the tool in place. It is contemplated that at least a portion of the materials of the shell 208 may undergo elastic deformation during the expansion process. Alternatively, at least a portion of the material of the shell 208 may undergo a plastic deformation during the expansion process to maintain it in engagement with the well casing 200.

Figure 5:
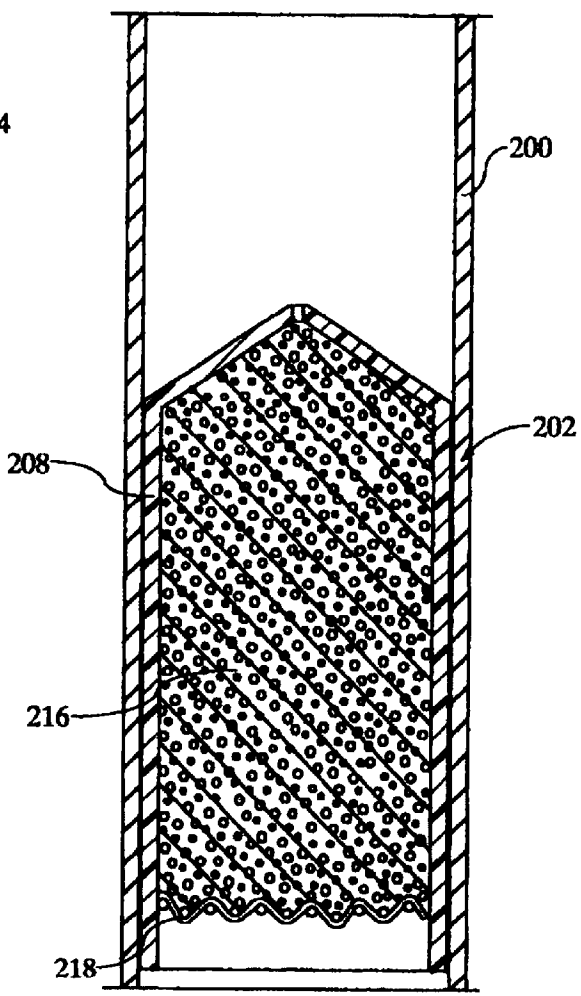
FIG. 5 is a cross-sectional view of the tool of FIG. 2 shown in place in the wellbore during well treatment.

In FIG. 5, the tool 202 is shown being used to block the well casing 200 in a well treatment step. A shearable connection (not shown) or the like allows the coil tubing 206 and running tool 204 to be separated from the tool 202 and removed from the well. Well treating fluid and slurry's such as acids, cement, gels, and the like are pumped down the well and fluid flow is directed by the tool or prevented from passing the tool. After the pumping is completed the plug is left in the wellbore and deteriorates and dissolves as previously described. No further intervention in the well is necessary to remove the tool 202.

Figure 6:
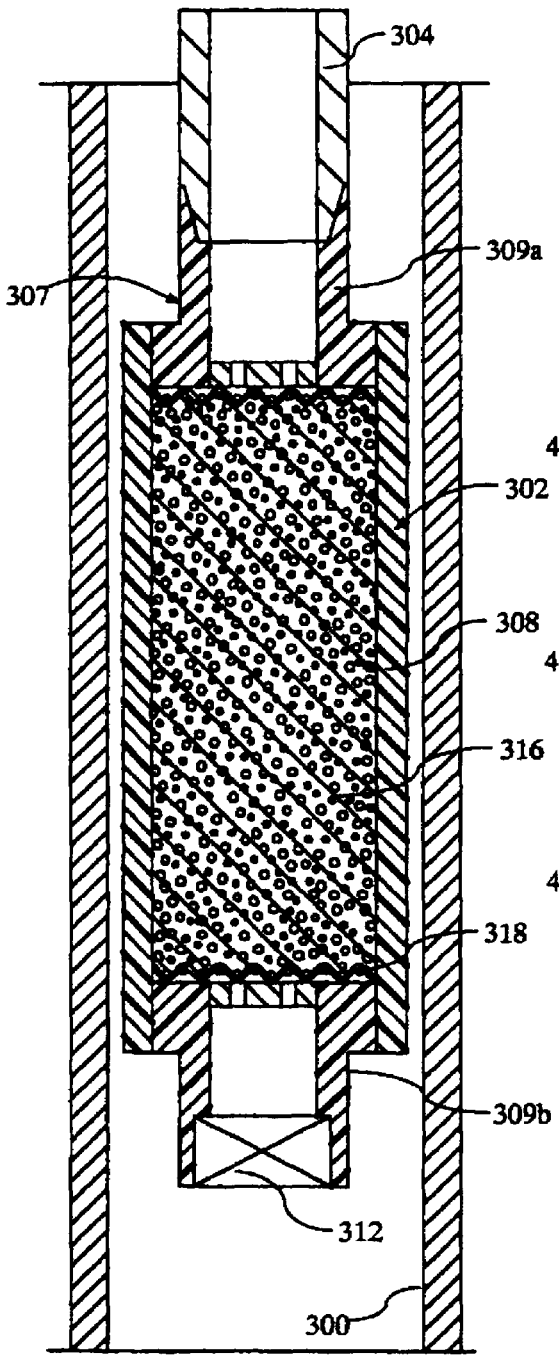
FIG. 6 is a partial cross-sectional view of a wellbore casing having disposed therein a downhole tool according to another embodiment of the present invention.

In another embodiment shown in FIG. 6, the bridge plug type downhole tool 302 is releasably suspended in the wellbore 300 from a running tool 304. Tool 302 has a body 307 formed from a radially expandable shell 308 and two end pieces 309a and 309b forming a chamber containing a volume of water-swellable material 316. In this embodiment the shell is in the form of a circular cross-section tubular member. In this embodiment the two end pieces 309 are made from a relatively rigid deteriorable material while the shell 308 preferably is made of more flexible or more deformable deteriorable material to allow its radial deformation against the wellbore 300. The running tool 304 can have a suitable fill valve with recirculation and fill ports (not shown). A suitable screen 318 and removable plug 312 is mounted at the lower end of the chamber. The tool 302 is installed, expanded, detached from the running tool and removed from the well by the process of material degradation as described in the previous embodiments.

A downhole tool according to the invention preferably includes at least one sealing element operatively connected to the portion of the body that is radially expandable, whereby when radially expanded the sealing can sealingly engage the wellbore. Further, a downhole tool according to the invention can preferably include a plurality of gripping elements operatively connected to the portion of the body that is radially expandable, whereby when radially expanded the gripping elements can grippingly engage the wellbore.

Figure 7:
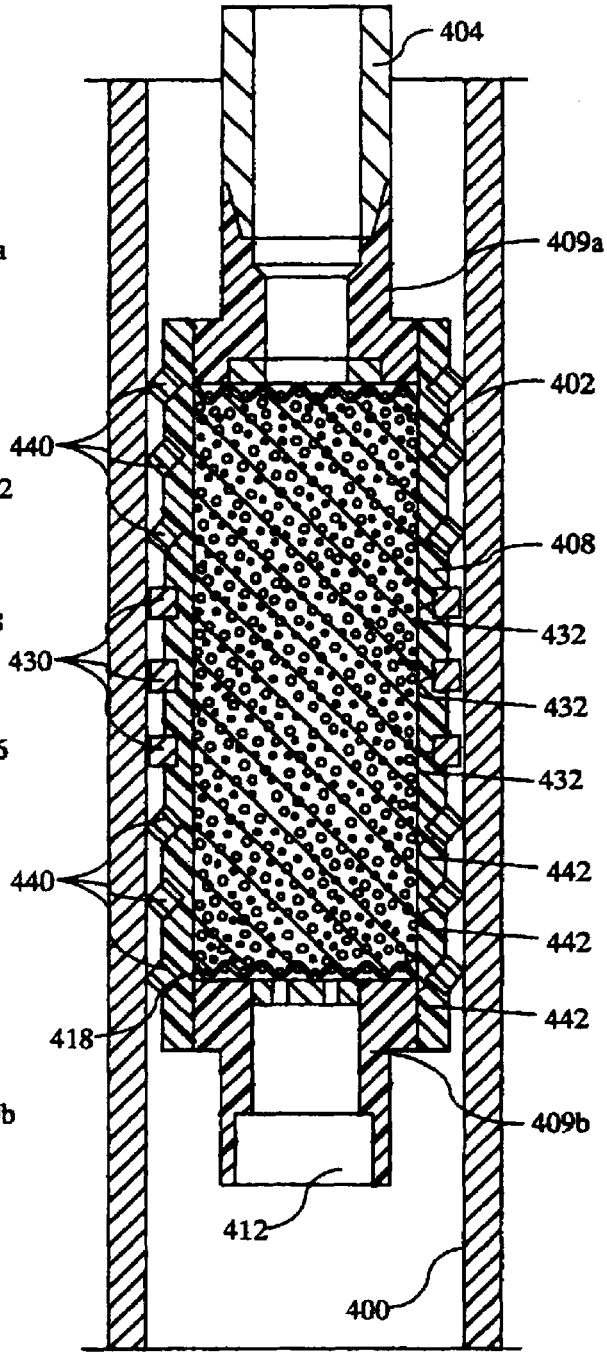
FIG. 7 is a partial cross-sectional view of a wellbore casing having disposed therein in an expanded condition a downhole tool according to a further embodiment of the present invention.

For example, the downhole tool 402 embodiment of FIG. 7 is identical to the FIG. 6 embodiment having end pieces 409a and 409b except that the exterior surface of the shell 408 carries sealing elements 430 and gripping elements 440 which are urged into contact with the wellbore 400 when the swellable material 416 is expanded. Preferably, the sealing elements 430 are resilient rings mounted in annular grooves 432 in the exterior of the shell 408. When the tool is radially expanded, the sealing elements 430 engage the wellbore 400 and block fluid flow axially past the plug 402. In the illustrated embodiment the gripping elements 440 comprise a plurality of hardened teeth mounted in recesses or pockets 442. When the tool is expanded the teeth contact and engage the wellbore 400 to hold the tool 402 in place.

Figure 7A:
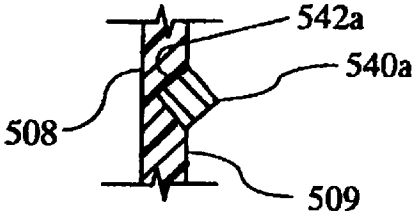
FIG. 7A is a is a partial cross-sectional view of an example of a gripping element which may be used by the embodiments of the present invention.

The sealing and gripping elements disclosed with regard to the FIG. 7 embodiment could be incorporated if desired in any of the other embodiments. Further, a variety of grip and seal embodiments may be used with the various aspects of the present invention. By way of illustration, some of these embodiments are illustrated in FIGS. 7A through 7D wherein a portion of a shell 508 is shown having an external surface 509. As shown in FIG. 7A, embedded in an exterior surface 509 is a grip member 540*a* disposed within a recess 542*a*. Grip member 540*a* will engage the wellbore wall when the tool is expanded to assist in to maintaining relative longitudinal position in the wellbore. The grip member 540*a* may be molded into the exterior surface 509 such that it is firmly embedded in the material of the shell 508. Alternatively, the grip member 540*a* may be bonded to the exterior surface 509 using adhesives or cement. Still further, it is contemplated that the grip member 540*a* may be mechanically coupled to the exterior surface 509. As shown the grip member 540*a* has a point or an edge 544. The grip member 540*a* is made from a relatively harder material than the shell 508 so that the point or edge 544 can engage the internal surface of the well casing.

The grip member 540*a* may be made of either deteriorable material, or even metallic or other hard non-metallic material. If made from non-deteriorable materials, small the grip members 540*a* will either fall to the bottom of the well or flow out with the production as the other components of the tool 508 deteriorate and dissolve. Indeed, it is preferable that any other components such as screens, valves or the like, if any, that are required to be made of non-deteriorable materials should be kept to a minimum.

Figure 7B:
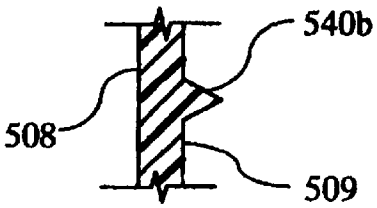
FIG. 7B is a partial cross-sectional view of another example of a gripping element which may be used by the embodiments of the present invention.

FIG. 7B illustrates another embodiment of a grip member. In this embodiment, a wedge 540*b* is integrally formed with the shell 508. The wedge 540*b* may be a semi-circular shape positioned at various points around the circumference of the downhole tool. Using a series of short wedges, as opposed to a single radial wedge, would allow the downhole tool to expand without developing ring tension in the wedge.

Figure 7C:
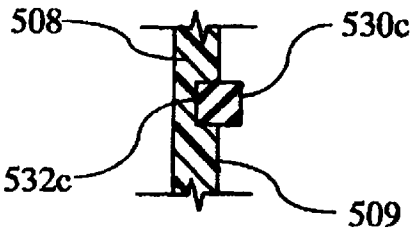
FIG. 7C is a partial cross-sectional view of an example of a sealing member which may be used by the embodiments of the present invention.

FIG. 7C depicts an embodiment of a sealing member. A sealing member 530*c* is embedded into a recess 532c in the shell 508. In this embodiment, the sealing member 530*c* is rectangular in cross-sectional shape. However, any appropriate cross-sectional shape may be used. For instance, the sealing member 530*c* could also have a triangular or circular cross sectional shape, or any combination of shapes. As previously explained, the shell 508 may be made from a flexible material so that it can expand radially and force the sealing member 530*c* to press tightly up against the internal surface of the wellbore, thereby creating an effective radial seal.

Figure 7D:
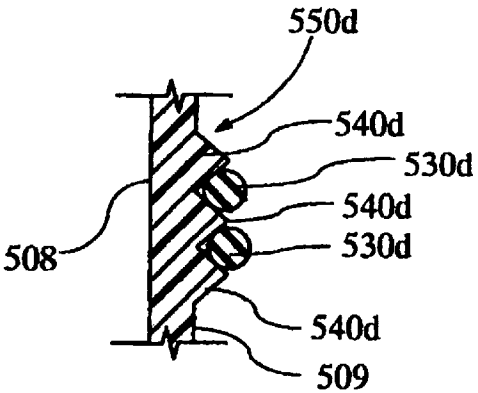
FIG. 7D is a partial cross-sectional view of another example of a sealing member which may be used by the embodiments of the present invention.

A detail of a grip and seal combination system is shown in FIG. 7D. A grip and seal combination 550*d* includes a plurality of gripping projections 540*d* extending from the outer surface of the shell 508. The gripping projections 540*d* are formed of a substantially harder material. Sealing members 530*d* are formed of a substantially softer material than the gripping projections. Sealing members 530*d* are shown disposed between the gripping projections 540*d*. It will be understood that as the shell 508 expands, the sealing members 530*d* are compressed against the internal surface of the well casing. This compression causes the sealing members 530*d* to yield such that the harder tips of the gripping projections 540*d* can project beyond the sealing members into engagement with the well casing.

Figure 8:
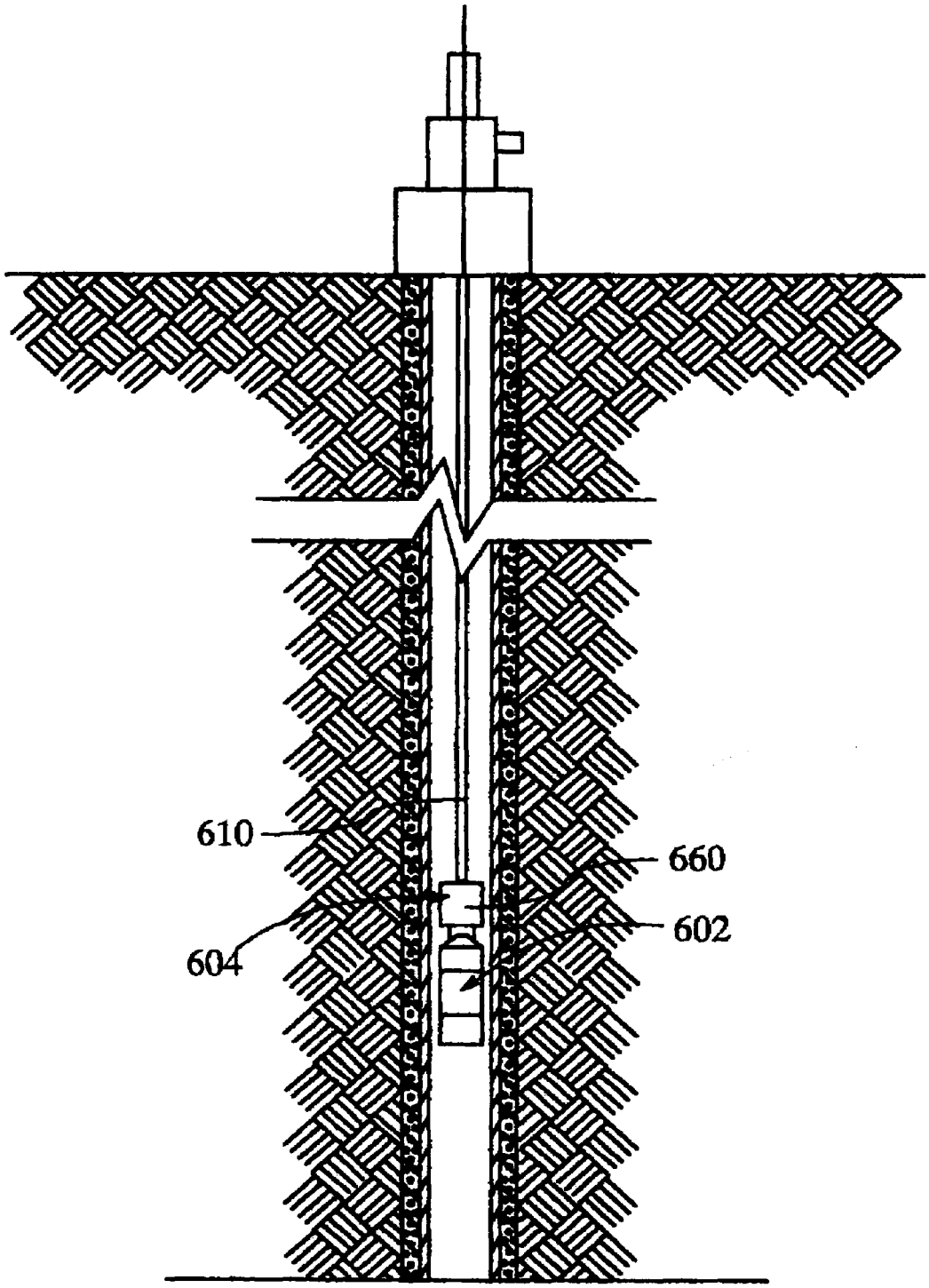
FIG. 8 is a cross-sectional view of an exemplary operating environment depicting another embodiment of a downhole tool according to the present invention being lowered into a wellbore extending into a subterranean formation.

In FIG. 8 another embodiment of the tool of the present invention is shown. In this embodiment a downhole well tool 602 of the type described herein is shown releasably connected to a running tool 604 suspended in the well by a wireline 610. The details of this embodiment can be in accord with any of the tools made of deteriorable and swellable material described herein. The running tool 602 includes a container 660 containing a sufficient volume of a suitable fluid to hydrate the water-swellable material in the tool. Upon actuation of a suitable valve in the running tool, fluid flows into the chamber in the tool 602 into contact with the water-swellable material therein. As previously described after the tool expands radially the running tool separates from the running tool.

Figure 9:
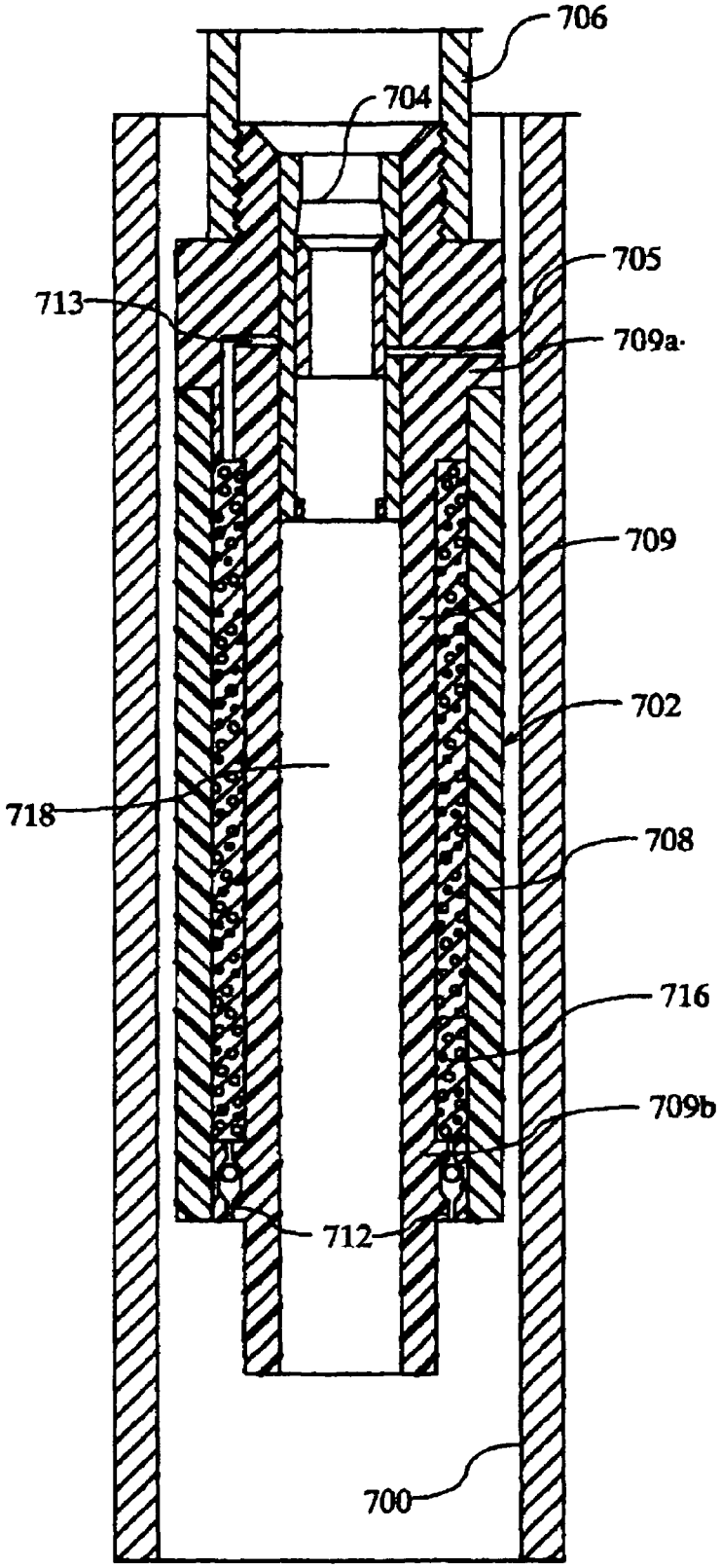
FIG. 9 is a partial cross-sectional view of a wellbore casing having disposed therein a downhole tool according to another embodiment of the present invention.

In FIG. 9, a further embodiment of a well tool 702 of present invention is shown in the form of a packer. Well tool 702 is in the form of a packer is connected to and suspended in wellbore 700 from tubing string 706. In this embodiment the body comprises a mandrel 709 having central passageway and axially spaced annular flanges 709*a* and 709*b* on its exterior surface. A setting tool 704 is mounted in the central passageway by sear pin 705. A cylindrical expandable shell 708 is mounted from the flanges and forms an annular chamber around the mandrel. The chamber contains a volume of water-swellable material 716. Mandrel 709 has a central passageway 718 extending there through. The mandrel passageway is in fluid communication with the tubing string 706. The body and water-swellable materials of the tool 702 are made from deteriorable and dissolvable materials as described with respect to the previous embodiments.

Once the tool 702 is in position in the well, it is expanded into engagement with the wellbore 700. A valve element in the setting tool 704 is shifted by pumping a ball down the well bore and against a seat on the valve. As described with the previous embodiments the shifted valve opens fill port 713 supplying fluid into chamber. Instead of the dislodging a plug, tool 702 uses an alternative embodiment in which check valves 712 are located at the bottom of the chamber and are arranged to allow flow out of the chamber but blocks flow in the reverse direction. A suitable screen above the check valve (not shown) can prevent particulate material from exiting the chamber through the check valve. As is disclosed in the previous embodiments, supplying an aqueous fluid into chamber 710 displaces any non-aqueous fluids and causes the material 716 to swell radially expanding the shell into sealing contact with the wellbore 700. Once the tool is expanded pressure in the tubing can be raised sufficiently to shear pin 705 allowing the setting tool 705 to be forced out of the tool through passageway 718. Once installed the tool 702 can be used as a packer (or the setting tool left in place to function as a frac plug) and then disconnected from the tubing string and left in the well to deteriorate and dissolve in accordance with the present inventions.

Figure 10:
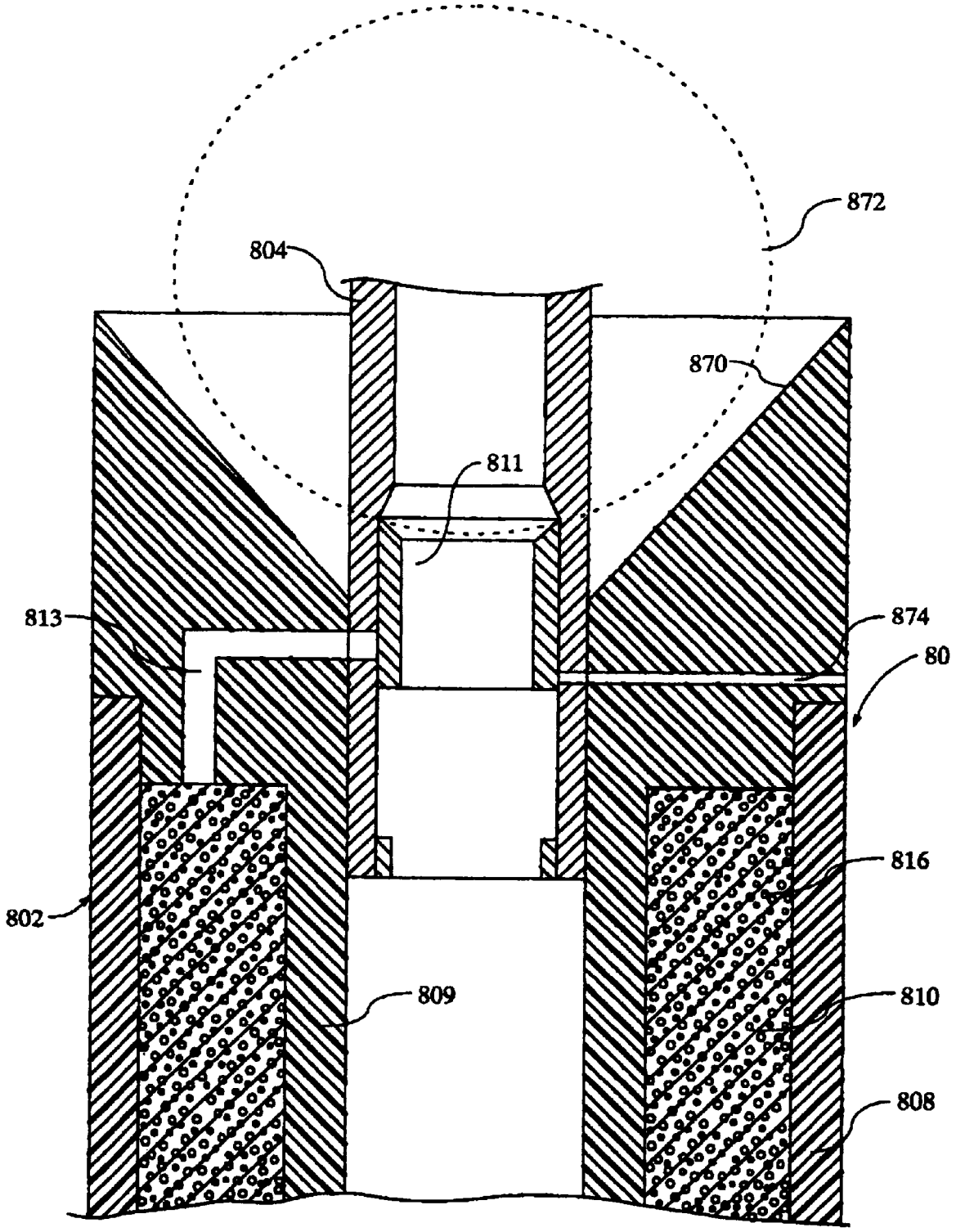
FIG. 10 is an enlarged partial cross-sectional view of the upper end of a downhole tool according to another embodiment of the present invention.

Referring now to FIG. 10, there is shown the upper end of a tool comprising an additional embodiment of the present invention. In this embodiment the tool 802 is a frac plug. An upward facing seat 870 is formed on the upper end of the mandrel 809 for receiving a ball valve element 872 (shown in phantom lines). With the exception of the upper end the frac plug 802 is constructed in the same manner as the packer 702. As shown the running tool 804 supported from a well tubing string is releasably connected to the mandrel 809 by one or more shear pins 874 or the like. Tool 804 has a shiftable sleeve valve 811 that closes off the filling port 813 during run in. To shift the sleeve 811 down to open port 813, a ball (not show) is dropped on the upper end of valve 811 and pressure is applied to the tubing string. The tool 870 is installed by the swelling of the water-swellable material 816 in chamber 810 until the shell 808 contacts the wellbore. The running tool 804 is separated from the tool 802 by shearing pin(s) 874 and thereafter the ball valve element 872 is dropped down the well to engage seat 870. The ball valve, like the remaining portions of the tool 802 preferably is made from deteriorable and dissolvable materials.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A downhole tool for use in a wellbore, comprising:

a body having a chamber, wherein at least a portion of the body is radially expandable;

a plurality of gripping elements operatively connected to the portion of the body that is radially expandable, whereby when radially expanded the gripping elements can grippingly engage the wellbore; and a water-swellable material in the chamber, wherein the water-swellable material or a hydrated product thereof is dissolvable or suspendable in water.

2. The downhole tool of claim 1 further comprising at least one sealing element operatively connected to the portion of the body that is radially expandable, whereby when radially expanded the sealing element can sealingly engage the wellbore.

3. A downhole tool for use in a wellbore, comprising:

a body having a chamber, wherein at least a portion of the body is radially expandable;

a plurality of gripping elements operatively connected to the portion of the body that is radially expandable, whereby when radially expanded the gripping elements can grippingly engage the wellbore; and a water-swellable material in the chamber, wherein the water-swellable material or a hydrated product thereof is dissolvable or suspendable in water;

wherein at least a portion of the body is made with a material that is deteriorable by hydrolysis.

4. The downhole tool of claim 3 wherein the deteriorable material comprises one or more compounds selected from the group consisting of: polysaccharides; chitin; chitosans; proteins; and aliphatic polyesters.

5. The downhole tool of claim 3 wherein the deteriorable material is elastically or plastically deformable.

6. The downhole tool of claim 3 wherein the deteriorable material further comprises a plasticizer.

7. The downhole tool of claim 6 wherein the deteriorable material is poly(lactic acid) and the plasticizer comprises a derivative of oligomeric lactic acid.

8. A downhole tool for use in a wellbore, comprising:

a body having a chamber, wherein at least a portion of the body is radially expandable;

a plurality of gripping elements operatively connected to the portion of the body that is radially expandable, whereby when radially expanded the gripping elements can grippingly engage the wellbore; and a water-swellable material in the chamber, wherein the water-swellable material or a hydrated product thereof is dissolvable or suspendable in water;

wherein the water-swellable material expands at least about 2.5% in the presence of an aqueous fluid.

9. A downhole tool for use in a wellbore, comprising:

a body having a chamber, wherein at least a portion of the body is radially expandable;

a plurality of gripping elements operatively connected to the portion of the body that is radially expandable, whereby when radially expanded the gripping elements can grippingly engage the wellbore; and a water-swellable material in the chamber, wherein the water-swellable material or a hydrated product thereof is dissolvable or suspendable in water;

wherein the water-swellable material comprises an anhydrous borate material.

10. A downhole tool for use in a wellbore, comprising:

a body having a chamber, wherein at least a portion of the body is radially expandable;

a plurality of gripping elements operatively connected to the portion of the body that is radially expandable, whereby when radially expanded the gripping elements can grippingly engage the wellbore; and a water-swellable material in the chamber, wherein the water-swellable material or a hydrated product thereof is dissolvable or suspendable in water;

wherein the water-swellable material is in the form of a particulate solid.

11. A downhole tool for use in a wellbore, comprising:

a body having a chamber, wherein at least a portion of the body is radially expandable;

a plurality of gripping elements operatively connected to the portion of the body that is radially expandable, whereby when radially expanded the gripping elements can grippingly engage the wellbore; and a water-swellable material in the chamber, wherein the water-swellable material or a hydrated product thereof is dissolvable or suspendable in water; and a non-aqueous material in the chamber.

12. A downhole tool for use in a wellbore, comprising:

a body having a chamber, wherein at least a portion of the body is radially expandable, and at least a portion of the body is made with a material that is deteriorable by hydrolysis; and a water-swellable material in the chamber, wherein the water-swellable material comprises an anhydrous borate material.

13. The downhole tool of claim 12 further comprising at least one sealing element operatively connected to the portion of the body that is radially expandable, whereby when radially expanded the sealing element can sealingly engage the wellbore.

14. The downhole tool of claim 13 further comprising a plurality of gripping elements operatively connected to the portion of the body that is radially expandable, whereby when radially expanded the gripping elements can grippingly engage the wellbore.

15. The downhole tool of claim 12 further comprising a plurality of gripping elements operatively connected to the portion of the body that is radially expandable, whereby when radially expanded the gripping elements can grippingly engage the wellbore.

16. The downhole tool of claim 12 wherein the deteriorable material comprises one or more compounds selected from the group consisting of: polysaccharides; chitin; chitosans; proteins; and aliphatic polyesters.

17. The downhole tool of claim 12 wherein the deteriorable material is elastically or plastically deformable.

18. The downhole tool of claim 12 wherein the deteriorable material further comprises a plasticizer.

19. The downhole tool of claim 12 wherein the water-swellable material expands at least about 2.5% in the presence of an aqueous fluid.

20. The downhole tool of claim 12 wherein the water-swellable material is in the form of a particulate solid.

21. The downhole tool of claim 12 further comprising a non-aqueous material in the chamber.

22. A process of temporarily blocking or sealing a wellbore, comprising:

providing an apparatus comprising:

a body having a chamber, wherein at least a portion of the body is radially expandable; and a water-swellable material in the chamber, wherein the water-swellable material is dissolvable or suspendable in water, and wherein the water-swellable material comprises an anhydrous borate material;

moving the apparatus to a position in the wellbore;

exposing the water-swellable material to water or an aqueous fluid to expand the apparatus into engagement with the wellbore;

performing a well completion, servicing, or workover operation in which the apparatus directs the flow of fluid; and thereafter, allowing the water-swellable material to dissolve.

23. The process of claim 22 wherein at least a portion of the body is made with a material that is deteriorable by hydrolysis.

24. The process of claim 23 wherein the deteriorable material comprises one or more compounds selected from the group consisting of: polysaccharides; chitin; chitosans; proteins; and aliphatic polyesters.

25. The process of claim 22 wherein expanding the apparatus into engagement with the wellbore blocks fluid flow in at least one direction past the apparatus between a periphery of the apparatus and the wellbore.

26. A process of temporarily blocking or sealing a wellbore, comprising:

providing an apparatus comprising:

a body having a chamber, wherein at least a portion of the body is radially expandable;

a plurality of gripping elements operatively connected to the portion of the body that is radially expandable, whereby when radially expanded the gripping elements can grippingly engage the wellbore; and a water-swellable material in the chamber, wherein the water-swellable material is dissolvable or suspendable in water;

moving the apparatus to a position in the wellbore;

exposing the water-swellable material to water or an aqueous fluid to expand the apparatus into engagement with the wellbore;

performing a well completion, servicing, or workover operation in which the apparatus directs the flow of fluid; and thereafter, allowing the water-swellable material to dissolve.

27. A downhole tool for use in a wellbore, comprising:

a body having a chamber, wherein at least a portion of the body is radially expandable; and a water-swellable material in the chamber, wherein the water-swellable material or a hydrated product thereof is dissolvable or suspendable in water, and wherein the water-swellable material comprises an anhydrous borate material.

28. The downhole tool of claim 27 further comprising at least one sealing element operatively connected to the portion of the body that is radially expandable, whereby when radially expanded the sealing element can sealingly engage the wellbore.

29. The downhole tool of claim 28 further comprising a plurality of gripping elements operatively connected to the portion of the body that is radially expandable, whereby when radially expanded the gripping elements can grippingly engage the wellbore.

30. The downhole tool of claim 27 further comprising a plurality of gripping elements operatively connected to the portion of the body that is radially expandable, whereby when radially expanded the gripping elements can grippingly engage the wellbore.

31. A downhole tool for use in a wellbore, comprising:

a body having a chamber, wherein at least a portion of the body is radially expandable;

at least one sealing element operatively connected to the portion of the body that is radially expandable, whereby when radially expanded the sealing element can sealingly engage the wellbore, and wherein the sealing element is a resilient ring mounted in an annular groove in the exterior of the body, whereby when the tool is radially expanded, the sealing element engages the wellbore and blocks fluid flow axially past the tool; and a water-swellable material in the chamber, wherein the water-swellable material or a hydrated product thereof is dissolvable or suspendable in water, wherein the water-swellable material comprises an anhydrous borate material.

32. A downhole tool for use in a wellbore, comprising:

a body having a chamber, wherein at least a portion of the body is radially expandable;

at least one sealing element operatively connected to the portion of the body that is radially expandable, whereby when radially expanded the sealing element can sealingly engage the wellbore; and a water-swellable material in the chamber, wherein the water-swellable material or a hydrated product thereof is dissolvable or suspendable in water, and wherein the water-swellable material comprises an anhydrous borate material.

33. A process of temporarily blocking or sealing a wellbore, comprising:

providing an apparatus comprising:

a body having a chamber, wherein at least a portion of the body is radially expandable; and a water-swellable material in the chamber, wherein the water-swellable material or a hydrated product thereof is dissolvable or suspendable in water;

moving the apparatus to a position in the wellbore;

exposing the water-swellable material to water or an aqueous fluid to expand the apparatus into engagement with the wellbore.

34. The process of claim 33, further comprising:

performing a well completion, servicing, or workover operation in which the apparatus directs the flow of fluid; and thereafter, allowing the water-swellable material to dissolve.

35. The process of claim 33 wherein the water-swellable material comprises an anhydrous borate material.

36. The process of claim 33 wherein the water-swellable material is in the form of a particulate solid.

37. The process of claim 33 wherein at least a portion of the body is made with a material that is deteriorable by hydrolysis.

38. The process of claim 33 wherein the apparatus further comprises at least one sealing element operatively connected to the portion of the body that is radially expandable, whereby when radially expanded the sealing element can sealingly engage the wellbore.

* * * * *